US006976851B2

(12) United States Patent
Huang

(10) Patent No.: US 6,976,851 B2
(45) Date of Patent: Dec. 20, 2005

(54) ELECTRICAL CONNECTOR HAVING MINIMAL WIPING TERMINALS

(75) Inventor: Yao-Chi Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/886,102

(22) Filed: Jul. 6, 2004

(65) Prior Publication Data

US 2005/0003684 A1 Jan. 6, 2005

(30) Foreign Application Priority Data

Jul. 4, 2003 (TW) ..... 92212386 U

(51) Int. Cl.[7] ..... H01R 9/09
(52) U.S. Cl. ..... 439/66
(58) Field of Search ..... 439/66, 71, 591

(56) References Cited

U.S. PATENT DOCUMENTS 4,553,192 A 11/1985 Babuka et al.
5,199,889 A * 4/1993 McDevitt, Jr. ..... 439/66
5,395,252 A * 3/1995 White ..... 439/66
5,984,693 A 11/1999 McHugh et al.
6,016,254 A * 1/2000 Pfaff ..... 439/71
6,113,399 A * 9/2000 Hundt et al. ..... 439/70
6,186,797 B1 2/2001 Wang et al.
6,193,524 B1 * 2/2001 Chang ..... 439/66
6,296,495 B1 10/2001 Wang et al.
6,409,521 B1 * 6/2002 Rathburn ..... 439/66

* cited by examiner

*Primary Examiner*—Briggitte R. Hammond
(74) *Attorney, Agent, or Firm*—Wei Te Chung

(57) ABSTRACT

An electrical connector (1) includes an insulative housing (30), and a multiplicity of terminals (10) received in the housing. Each terminal comprises a retaining portion (12), a soldering portion (18) extending from a bottom end of the retaining portion, and a spring portion (13) extending slantingly upwardly from a top end of the retaining portion. The spring portion comprises a first spring arm (14) extending slantingly upwardly from the top end of the retaining portion, and a second spring arm (16) extending slanting upwardly from a top end of the first spring arm an being directly above the first spring arm. A contacting portion (162) is defined at a distal end of the second spring arm. The first and second spring arms respective can resiliently deform in a different direction to provide resilient force to the contacting portion, and the contacting portion therefore engages with the CPU with minimal wiping.

20 Claims, 8 Drawing Sheets

ELECTRICAL CONNECTOR HAVING MINIMAL WIPING TERMINALS

BACKGROUND OF THE INVENTION

1. Field of the Invention

The present invention relates to an electrical connector, and particularly to an electrical connector having a plurality of minimal wiping terminals for electrically connecting an electronic package such as a land grid array (LGA) central processing unit (CPU) with a circuit substrate such as a printed circuit board (PCB).

2. Description of the Prior Art

Electrical connectors are widely used in electrically connecting electronic packages such as land grid array (LGA) central processing units (CPUs) with circuit substrates such as printed circuit boards (PCBs). Patented examples of such electrical connectors are disclosed in U.S. Pat. Nos. 4,553,192 and 6,296,495.

Referring to FIGS. 8 and 9, a conventional electrical connector 9 connects a CPU 8 with a PCB 7. The connector 9 comprises an insulative housing 91, and a multiplicity of terminals 92 received in the housing 91. The housing 91 defines a multiplicity of passageways 910 therethrough, for receiving a corresponding number of the terminals 92 therein.

Each terminal 92 comprises a retaining body 920 engagingly received in a corresponding passageway 910, a soldering portion 921 extending from a bottom end of the retaining body 920, and a cantilever 922 extending slantingly upwardly from a top end of the retaining body 920. The soldering portion 921 electrically connects with the PCB 7 via a solder ball 926. The cantilever 922 protrudes out from a top surface of the housing 91, and has a contacting portion 924 at a distal end thereof for electrically connecting with a corresponding metal contact pad 80 of the CPU 8. The connector 9 thus electrically connects the CPU 8 with the PCB 7.

With the prevailing trend toward miniaturization of computers, the sizes of electrical connectors used in computers are steadily becoming smaller. In contrast, the number of contacts used in modern electrical connectors is increasing to meet the growing need for more signal transmission. Accordingly, the terminal 92 may often be fabricated to be miniaturized, with the cantilever 922 being correspondingly small. When the contacting portion 924 of the terminal 92 engages with the pad 80, the cantilever 922 rotates about a junction of the cantilever 922 and the retaining body 920. The rotation comprises a horizontal displacement component and a vertical displacement component. The effect of the horizontal displacement is to make the contacting portion 924 frictionally wipe the pad 80. Particularly after repeated use of the connector 9, the wiping can result in poor connection between the contacting portion 924 and the pad 80.

In view of the above, a new electrical connector that overcomes the above-mentioned disadvantages is desired.

SUMMARY OF THE INVENTION

Accordingly, an object of the present invention is to provide a high-density electrical connector that has a plurality of electrical terminals reliably electrically connecting an electronic package such as a land grid array (LGA) central processing unit (CPU) with a circuit substrate such as a printed circuit board (PCB).

Another object of the present invention is to provide an electrical connector having a plurality of minimal wiping terminals that are configured to securely connect with an LGA CPU.

To fulfill the above-mentioned objects, an electrical connector in accordance with a preferred embodiment of the present invention comprises an insulative housing, and a plurality of terminals received in the housing. The housing defines an array of a multiplicity of passageways therethrough, for receiving a corresponding number of the terminals therein. Each terminal comprises a retaining portion, a soldering portion extending from a bottom end of the retaining portion for soldering to a PCB via a solder ball, and a spring portion extending slantingly upwardly from a top end of the retaining portion. The spring portion comprises a first spring arm extending slantingly upwardly from the top end of the retaining portion, and a second spring arm extending slanting upwardly from a top end of the first spring arm an being directly above the first spring arm. A multiplicity of barbs extends from two lateral edges of the retaining portion, for interferentially being received in the corresponding passageways of the housing. An arcuate contacting portion is defined at a distal end of the second spring arm, for resiliently electrically contacting a corresponding conductive pad of a CPU. The contacting portion and the retaining portion are located at opposite ends of the spring portion, and at a same side of the spring portion. When the connector engages with the CPU, the first spring arm and the second spring arm respective can resiliently deform in a different direction to provide resilient force to the contacting portion, and the contacting portion therefore engages with the CPU with minimal wiping relative to the CPU.

In an alternative embodiment of the present invention, an electrical connector comprising a plurality of first and second spring arms is provided.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
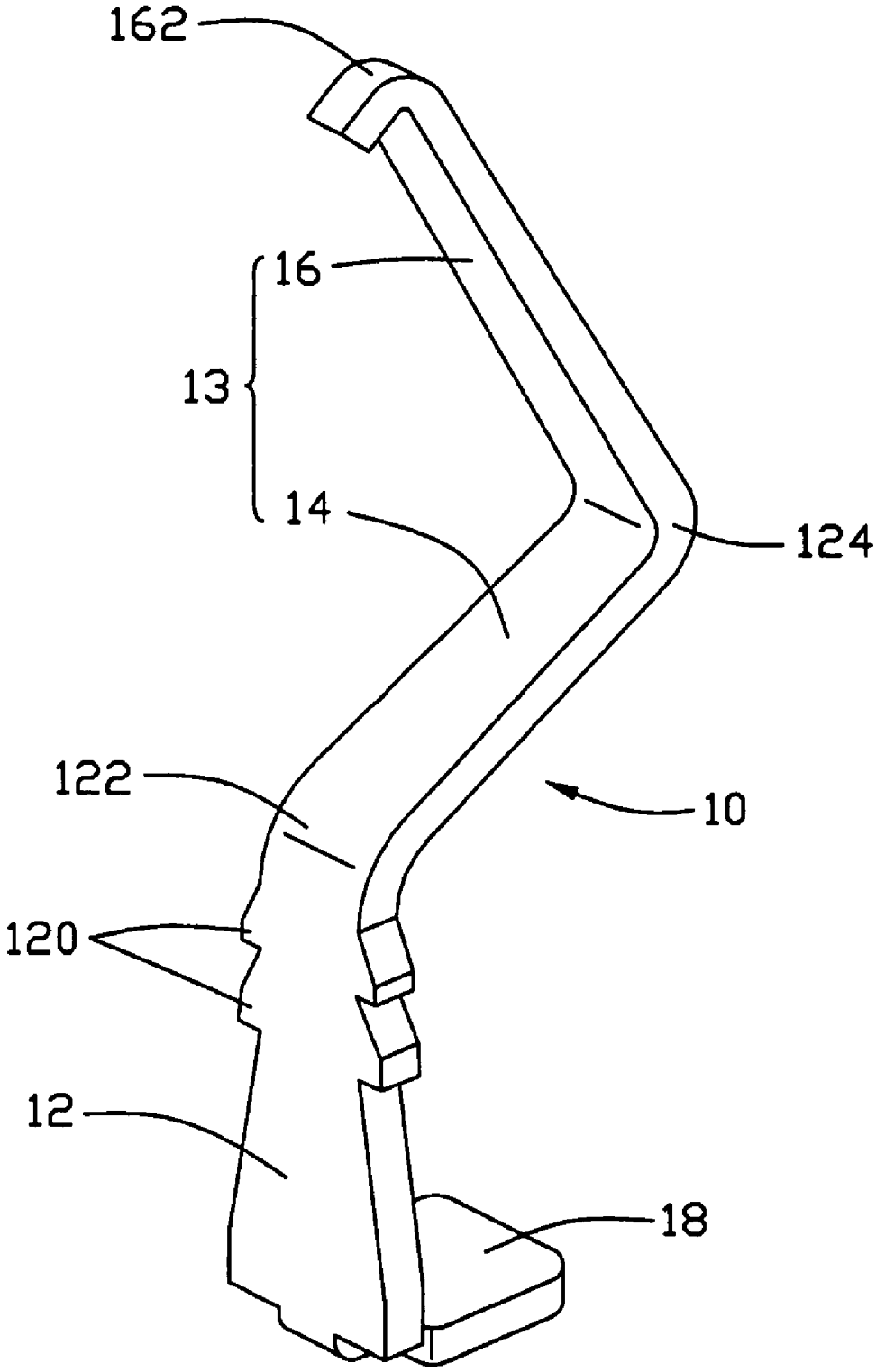
FIG. 1 is an isometric view of an electrical terminal of an electrical connector in accordance with the preferred embodiment of the present invention.
Figure 3:
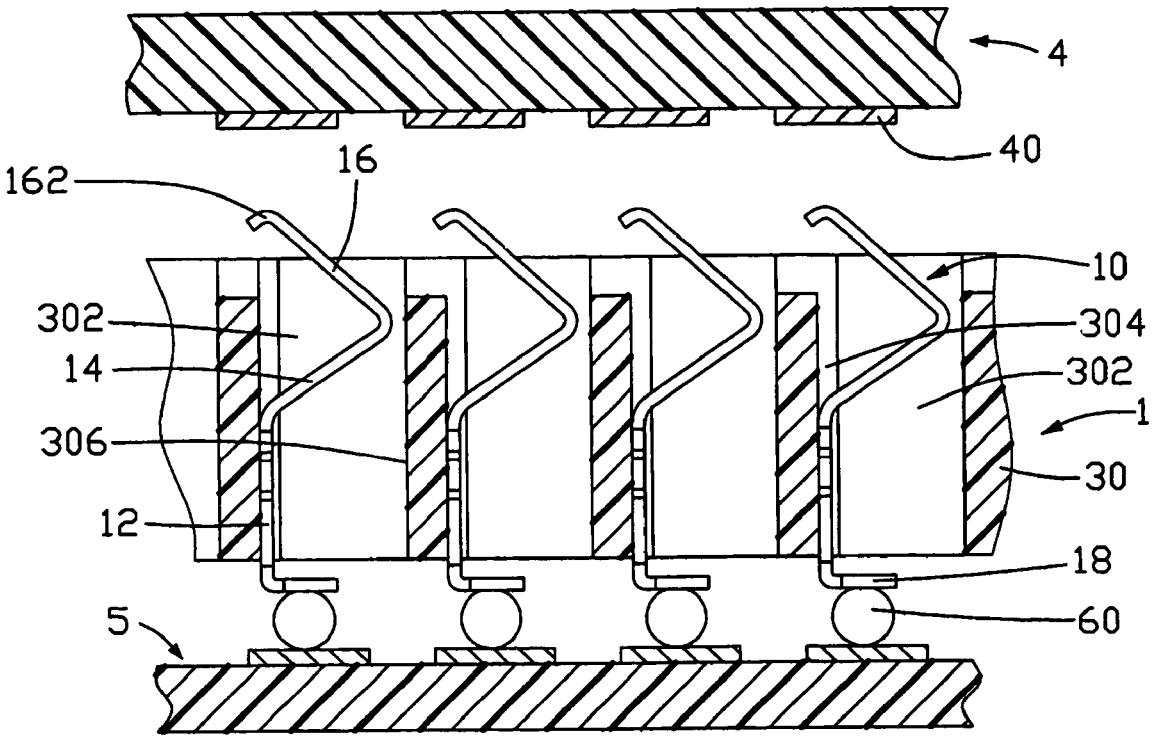
FIG. 3 is a schematic, cross-sectional view of part of the connector in accordance with the preferred embodiment of the present invention, showing soldering portions of several of terminals of FIG. 1 connected with a corresponding part of a PCB via solder balls, and a corresponding part of an LGA CPU above the connector ready to be connected with the terminals.

Referring to FIGS. 1 and 3, an electrical connector 1 in accordance with the preferred embodiment of the present invention is used for electrically connecting an electronic package such as a land grid array (LGA) central processing unit (CPU) 4 with a circuit substrate such as a printed circuit board (PCB) 5. The connector 1 comprises an insulative housing 30, and a plurality of terminals 10 received in the housing 30. The housing 30 defines an array of a multiplicity of passageways 302 therethrough, for receiving a corresponding number of the terminals 10 therein. Each passageway 302 has a slot 304 at an end thereof and is bounded by a sidewall 306 at an opposite end thereof.

Figure 2:
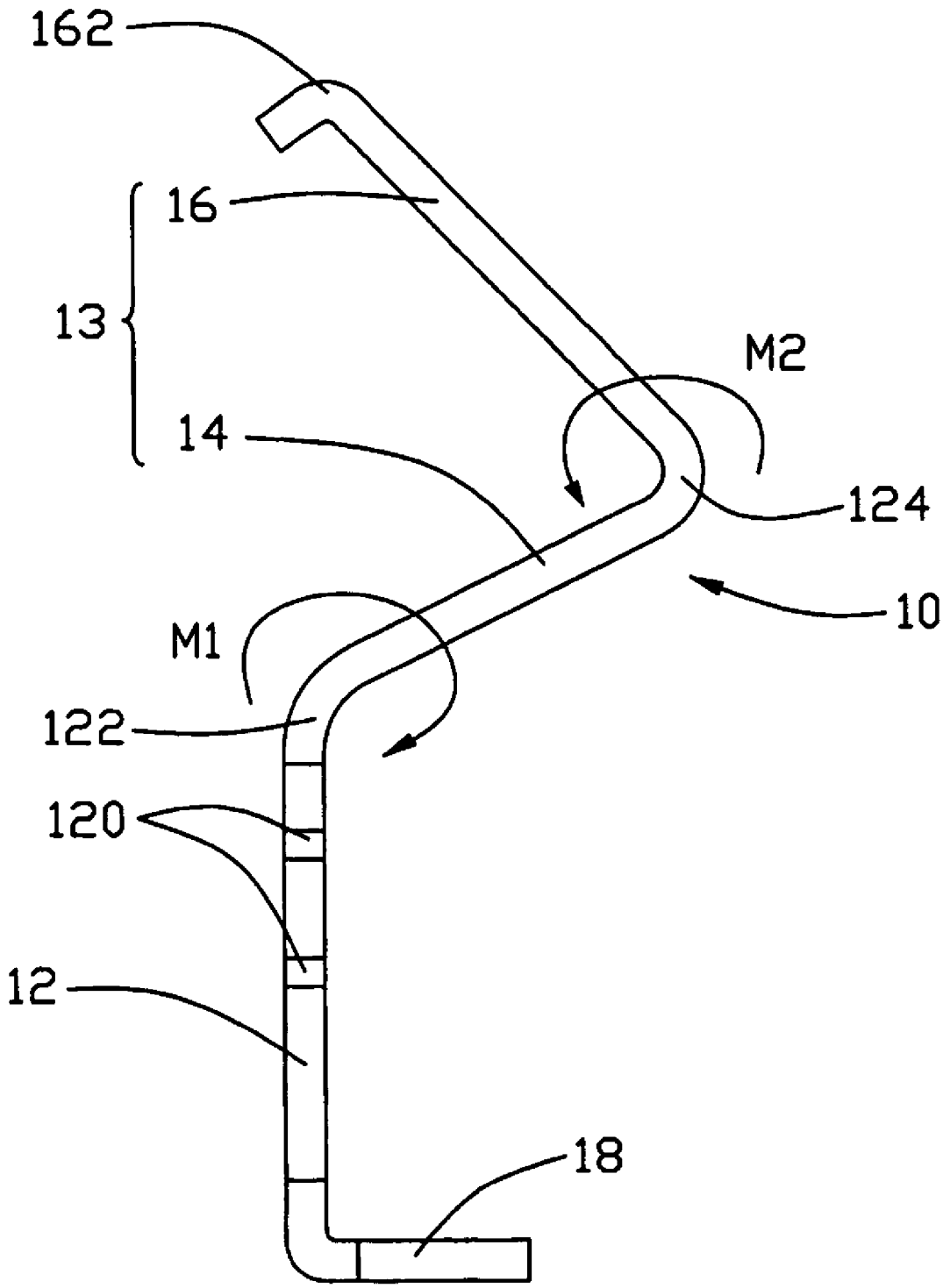
FIG. 2 is a side elevation of the contact of FIG. 1.

Referring to FIGS. 1 and 2, each terminal 10 comprises a retaining portion 12, a soldering portion 18 extending from a bottom end of the retaining portion 12, and a spring portion 13 extending slantingly upwardly from a top end of the retaining portion 12. The spring portion 13 comprises a first spring arm 14 extending slantingly upwardly from the top end of the retaining portion 12, and a second spring arm 16 extending slanting upwardly from a top end of the first spring arm 14 and being directly above the first spring arm 14. The retaining portion 12 has a plurality of barbs 120 at two lateral edges thereof. The barbs 120 interferentially engage with the housing 30 in the slot 304 of a corresponding passageway 302, such that the terminal 10 is secured in the housing 30. The first spring arm 14 forms an obtuse angle with the retaining portion 12. That is, an obtuse angle (see FIG. 2) is formed at a first junction portion 122 where the retaining portion 12 adjoins the first spring arm 14. The first spring arm 14 forms an angle with the second spring arm 16 in the range from an acute angle to an obtuse angle. A length of the first spring arm 14 is the same as a length of the second spring arm 16. The first spring arm 14 and the second spring arm 16 can resiliently deform in respectively different directions. In the preferred embodiment of the present invention, an acute angle (see FIG. 2) is formed at a second junction portion 124 where the first spring arm 14 adjoins the second spring arm 16. A space is formed between the second junction portion 124 and the sidewall 306 of the passageway 302, for providing room to enable the second spring arm 16 to elastically deform. An arcuate contacting portion 162 is defined at a distal end of the second spring arm 16, for resiliently electrically contacting a corresponding conductive pad 40 of the CPU 4 (see FIG. 3). The contacting portion 162 and the retaining portion 12 are located at opposite ends of the spring portion 13, and at a same side of the spring portion 13.

Figure 4:
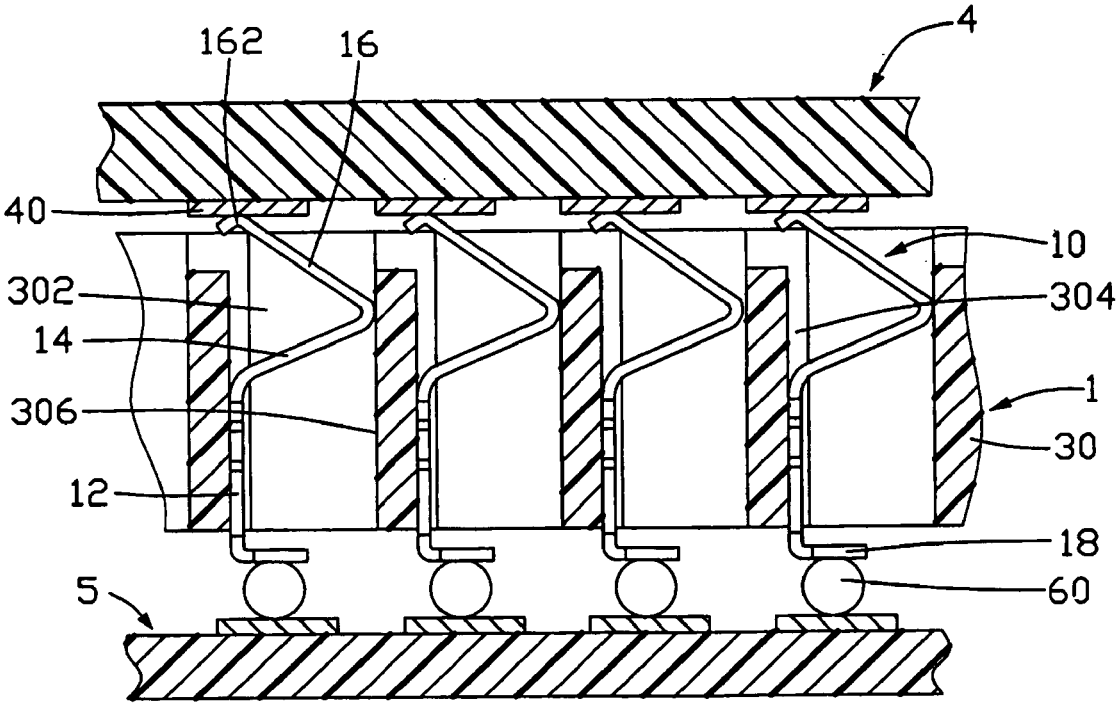
FIG. 4 is similar to FIG. 3, but showing the LGA CPU connected with the terminals.

Referring to FIGS. 3 and 4, the soldering portion 18 of each terminal 10 electrically connects with the PCB 5 via a solder ball 60. The second spring arm 16 protrudes out from a top surface of the housing 30. In assembly, a force is exerted down on the CPU 4 to make each pad 40 of the CPU 4 engage with the contacting portion 162 of the corresponding terminal 10, the first and second spring arms 14, 16 resiliently deform at the same time, and the contacting portion 162 reliably electrically contacts the pad 40 of the CPU 4. The connector 1 thus electrically connects the CPU 4 with the PCB 5.

In the above-described assembly process, the first spring arm 14 rotates about the first junction portion 122 in direction M1, and the second spring arm 16 rotates about the second junction portion 124 in an opposite direction M2 (see FIG. 2). Because the length of the first spring arm 14 is the same as that of the second spring arm 16, the degree of rotation M1 of the first spring arm 14 is the same as the degree of rotation M2 of the second spring arm 16. Accordingly, a horizontal component movement of the first spring arm 14 due to the rotation M1 covers a same distance as a horizontal component movement of the second spring arm 16 due to the rotation M2, with said two horizontal component movements being in opposite directions. Thus, the contacting portion 162 does not move along horizontal directions during the rotations M1, M2, and the contacting portion 162 undergoes no or minimal wipe relative to the pad 40 of the CPU 4. In addition, unlike in conventional connectors, the two spring arms 14, 16 cooperatively provide vertical displacement for the contacting portion 162, with their respective horizontal component movements being in opposite directions. Therefore said space between the second junction portion 124 and the sidewall 306 of the passageway 302 is reduced, and a width of the passageway 302 itself is reduced. Space occupied by the array of passageways 302 is reduced, thereby giving the connector 1 a high density of the terminals 10 and/or a reduced overall size.

Figure 5:
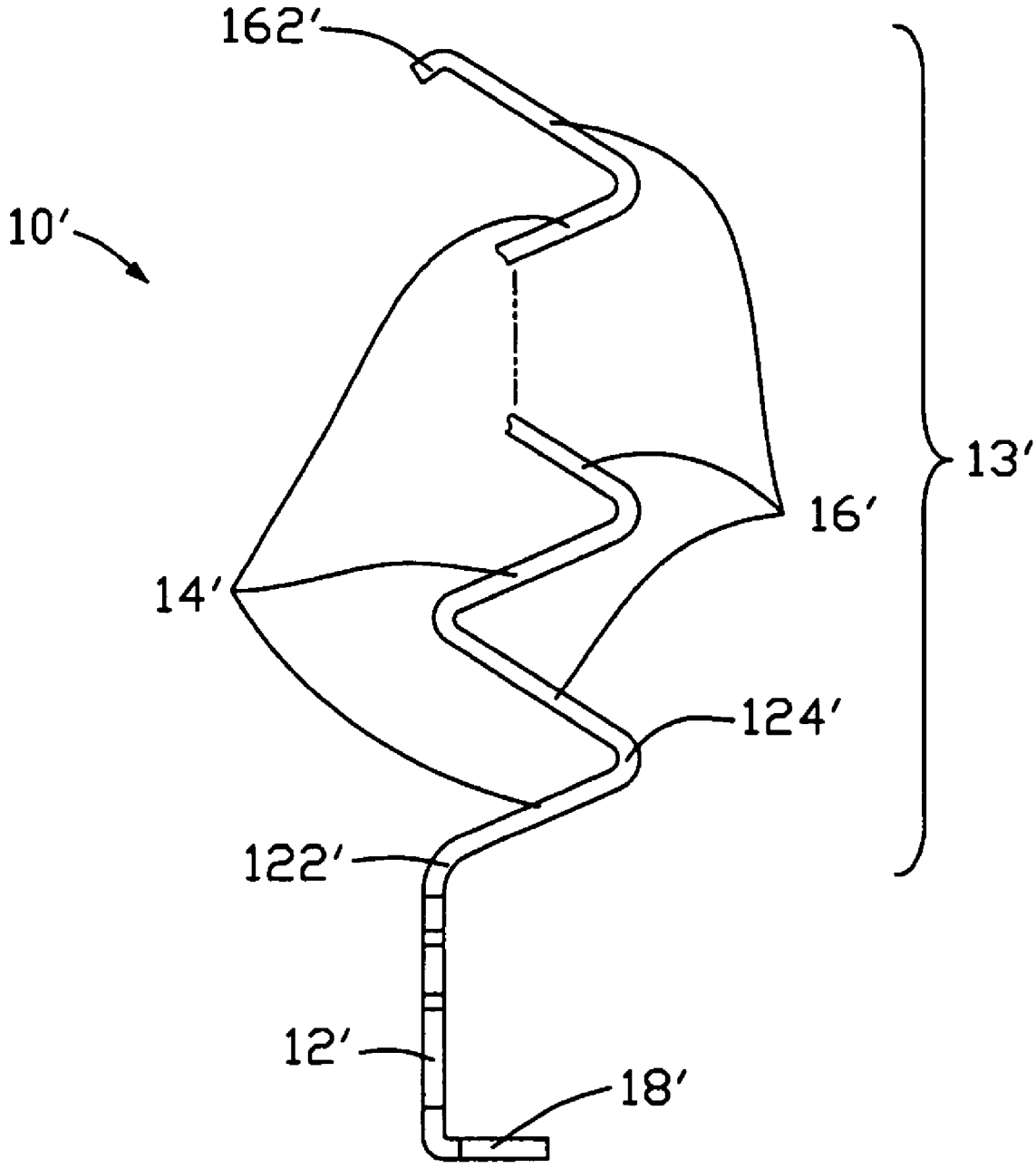
FIG. 5 is a side elevation of an electrical terminal of an electrical connector in accordance with the alternative embodiment of the present invention.
Figure 6:
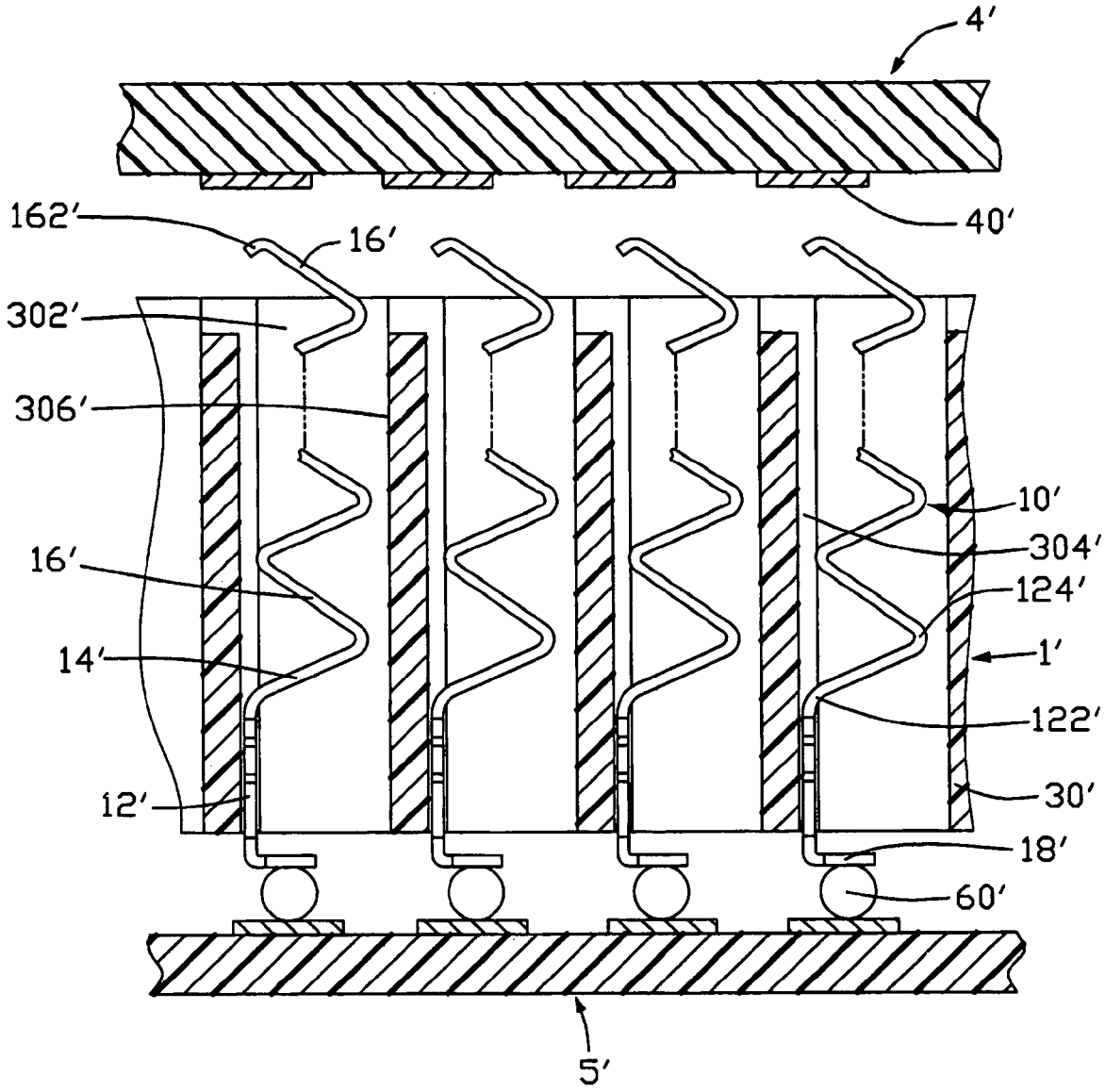
FIG. 6 is a schematic, cross-sectional view of part of the connector in accordance with the alternative embodiment of the present invention, showing soldering portions of several of terminals of FIG. 5 connected with a corresponding part of a PCB via solder balls, and a corresponding part of an LGA CPU above the connector ready to be connected with the terminals.
Figure 7:
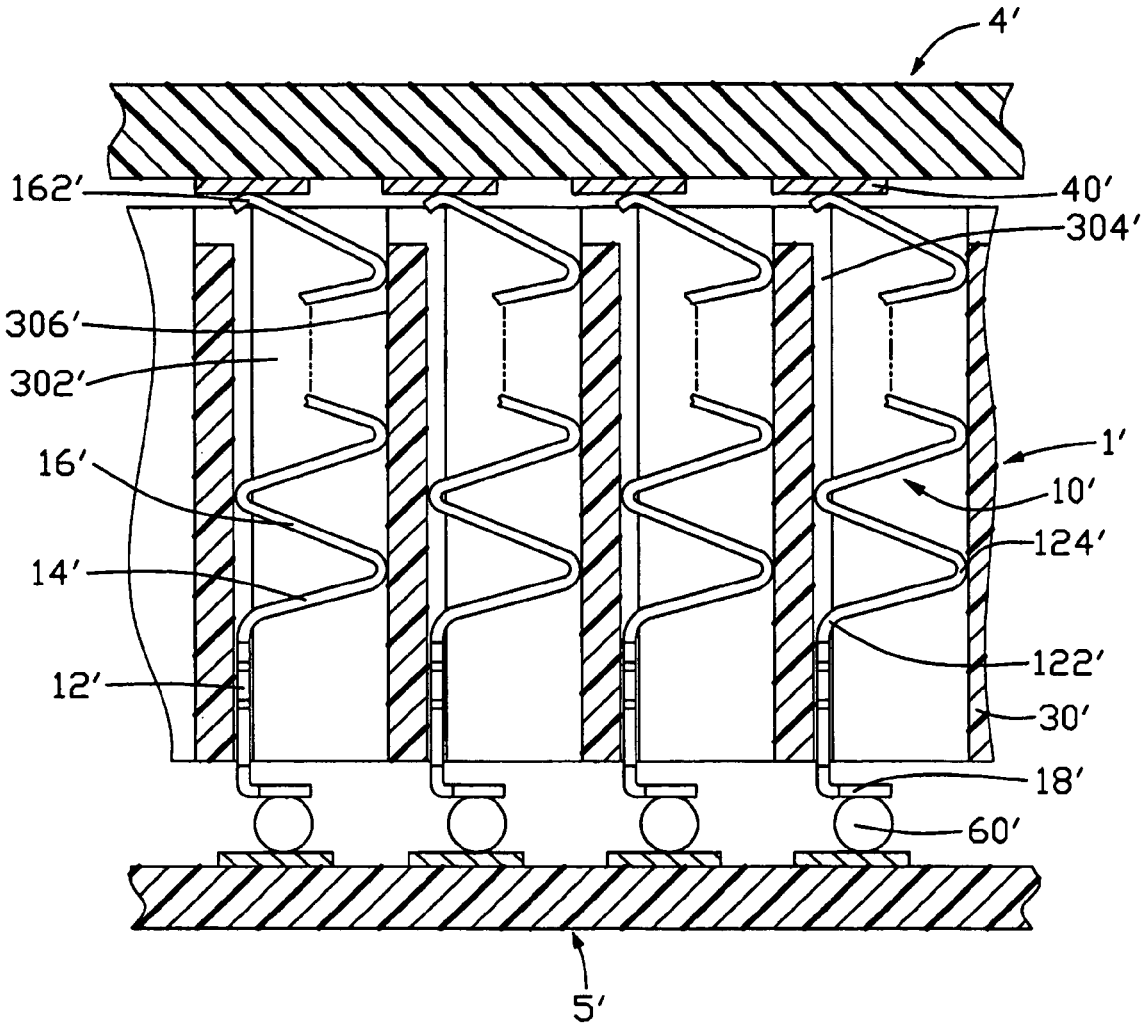
FIG. 7 is similar to FIG. 6, but showing the LGA CPU connected with the terminals.
Figure 8:
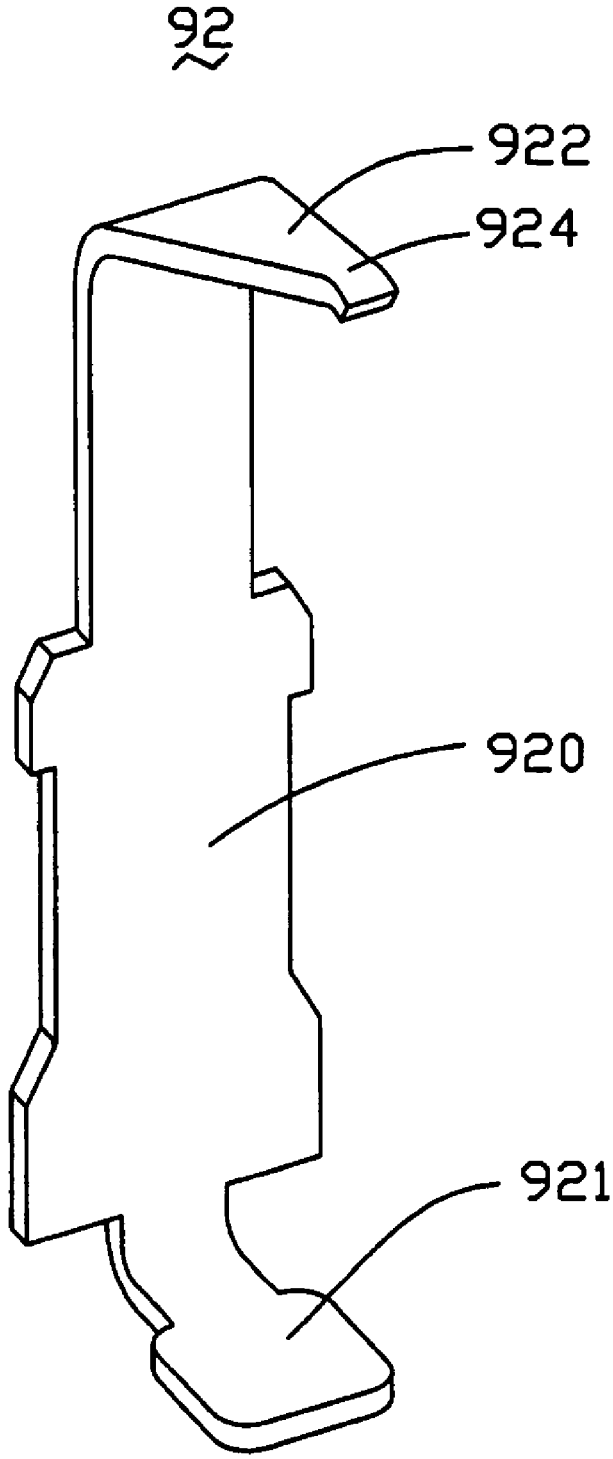
FIG. 8 (PRIOR ART)
FIG. 8 is an isometric view of an electrical terminal of a conventional electrical connector.
Figure 9:
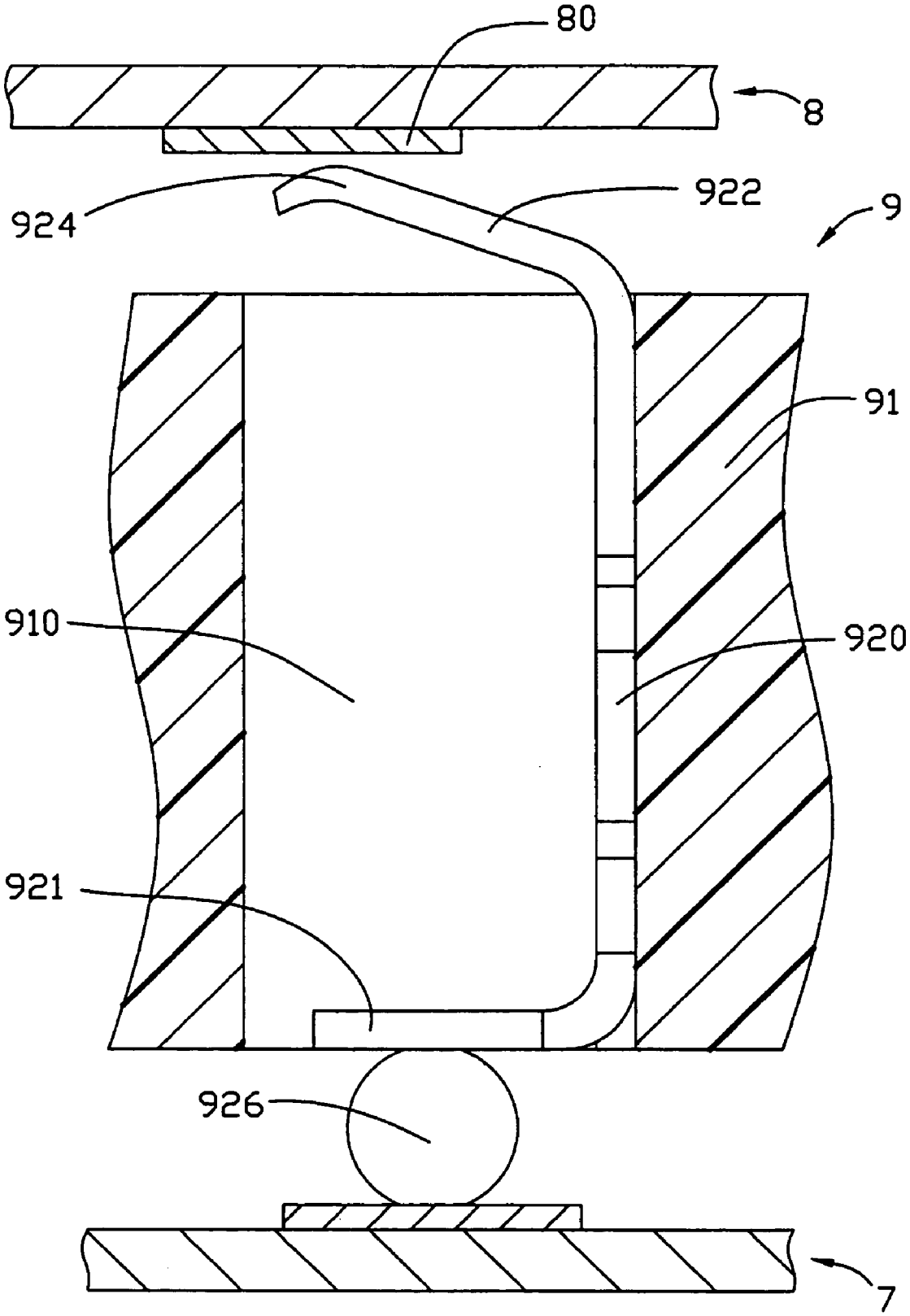
FIG. 9 (PRIOR ART)
FIG. 9 is a schematic, cross-sectional view of part of said conventional connector, showing a soldering portion of the contact of FIG. 8 connected with a corresponding part of a PCB via a solder ball, and a corresponding part of an LGA CPU above said connector ready to be connected with the terminal.

Referring to FIGS. 5–7, an electrical connector 1' in accordance with the alternative embodiment of the present invention has a structure similar to that of the connector 1 of the preferred embodiment. In the alternative embodiment, a spring portion 13' comprises a plurality of first spring arms 14' and second spring arms 16' alternately disposed along a length thereof. Thus an elasticity of a terminal 10' is enhanced, and a distance of each horizontal component movement of the first and second spring arms 14', 16' is reduced. Other components of the alternative embodiment are substantially the same as those of the preferred embodiment described above, with corresponding like reference numerals being used in FIGS. 5–7.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting an electronic package with a circuit substrate, the electrical connector comprising:

an insulative housing defining a plurality of passageways therethrough; and a plurality of terminals received in the passageways respectively, each terminal comprising a retaining portion engagingly received in a corresponding passageway of the housing, a soldering portion extending from the retaining portion, a spring portion extending slantingly upwardly from an upper end of the retaining portion, and a contacting portion defined at a distal end of the spring portion; wherein the spring portion comprises at least two spring arms alternately disposed along a length thereof, and each two adjacent spring arms form an angle therebetween in the range from an acute angle to an obtuse angle; wherein when the contacting portion is pressed downwardly by the electronic package, each two adjacent spring arms respectively resiliently deform in different directions, corresponding ends of said two adjacent spring arms each undergoing a horizontal and a vertical displacement, the horizontal displacement of said corresponding ends being substantially equal in magnitude but opposite in direction, whereby the contacting portion is deflectable substantially in a vertical direction only.

2. The electrical connector as claimed in claim 1, wherein an obtuse angle is formed at a junction portion where the retaining portion adjoins the spring arm.

3. The electrical connector as claimed in claim 1, wherein the passageway defines a slot at an end thereof and is bounded by a sidewall at the other end thereof.

4. The electrical connector as claimed in claim 3, wherein the retaining portion comprises a plurality of barbs at two lateral edges thereof for interferentially engaging with the housing in the slot of a corresponding passageway.

5. The electrical connector as claimed in claim 3, wherein two adjacent spring arms are interconnected by a junction portion, a space being formed between the junction portion and the sidewall.

6. The electrical connector as claimed in claim 5, wherein an acute angle is formed at the junction portion.

7. The electrical connector as claimed in claim 6, wherein the contacting portion is generally arcuate.

8. The electrical connector as claimed in claim 7, wherein the contacting portion and the retaining portion are located at opposite ends of the spring portion and at a same side of the spring portion.

9. The electrical connector as claimed in claim 8, wherein each spring arm has substantially a same length.

10. An electrical connector comprising:

an insulative housing assembly defining a plurality of vertical passageways therethrough; and a plurality of terminals retained in the corresponding passageways, each terminal including a soldering portion extending around a bottom face of the housing and a retaining portion engagingly received in the passageway, a spring portion extending slantingly upwardly from an upper end of the retaining portion, and a contacting portion formed at a distal end of the spring portion; wherein the spring portion is partially received in corresponding passageway and comprises at least a first spring arm extending slantingly upwardly from the top end of the retaining portion, and at least a second spring arm extending slanting upwardly from a top end of the first spring arm and being directly above the first spring arm, and wherein the first and second spring arms can respectively resiliently deform in different directions to provide resilient force to the contacting portion and partially be received in the passageway, whereby the contacting portion can engage with an electrical package with minimal wiping.

11. The electrical connector as claimed in claim 10, wherein an obtuse angle is formed at a junction portion where the retaining portion adjoins the first spring arm.

12. The electrical connector as claimed in claim 10, wherein the passageway defines a slot at an end thereof and is bounded by a sidewall at the other end thereof.

13. The electrical connector as claimed in claim 12, wherein the retaining portion comprises a plurality of barbs at two lateral edges thereof for interferentially engaging with the housing in the slot of a corresponding passageway.

14. The electrical connector as claimed in claim 12, wherein the first and second spring arms are interconnected by a junction portion, a space being formed between the junction portion and the sidewall.

15. The electrical connector as claimed in claim 14, wherein an acute angle is formed at the junction portion.

16. The electrical connector as claimed in claim 15, wherein the contacting portion is generally arcuate.

17. The electrical connector as claimed in claim 16, wherein the contacting portion and the retaining portion are located at opposite ends of the spring portion and at a same side of the spring portion.

18. The electrical connector as claimed in claim 17, wherein the at least a first spring arm and the at least a second spring arm have substantially a same length.

19. An electrical connector for use with an LGA type electronic device comprising:

an insulative housing defining a plurality of vertical passageways therethrough; and a plurality of terminals retained in the corresponding passageways, each terminal including a vertical planar retaining portion abutting against one inner wall face of the corresponding passageway, a soldering portion extending from a bottom end of the retaining portion away from said inner face, a spring portion extending slantingly upwardly from an upper end of the retaining portion away from the inner wall face, and a contacting portion formed at a distal end of the spring portion; wherein the spring portion defining a serpentine configuration, and the contacting portion is essentially located above and aligned with the retaining portion, and a partition wall between every adjacent two passageways, which includes the inner wall face, defines a recess in a top end so as to receive the contacting portion of the corresponding terminal therein when said corresponding terminal is deflected by said LGA type electronic device.

20. The electrical connector as claimed in claim 19, wherein said recess extends through said partition wall laterally so as to laterally communicate said two adjacent two passageways with each other.

* * * * *